US011026503B2

(12) United States Patent
O'Gara et al.

(10) Patent No.: US 11,026,503 B2
(45) Date of Patent: Jun. 8, 2021

(54) COLLAPSIBLE TABLE AND DESK ASSEMBLY FOR CONVERTING A STANDARD DESK INTO A STAND-UP DESK

(71) Applicants: Tadhg James O'Gara, Winston-Salem, NC (US); Dakota Pahel-Short, Winston-Salem, NC (US)

(72) Inventors: Tadhg James O'Gara, Winston-Salem, NC (US); Dakota Pahel-Short, Winston-Salem, NC (US)

(73) Assignee: Tadhg O'Gara, Winston-Salem, NC (US)

( * ) Notice: Subject to any disclaimer, the term of this patent is extended or adjusted under 35 U.S.C. 154(b) by 0 days.

(21) Appl. No.: 16/706,952

(22) Filed: Dec. 9, 2019

(65) Prior Publication Data

US 2020/0178683 A1 Jun. 11, 2020

Related U.S. Application Data

(60) Provisional application No. 62/777,536, filed on Dec. 10, 2018.

(51) Int. Cl.

| | |
|---|---|
| ***A47B 9/18*** | (2006.01) |
| ***A47B 21/02*** | (2006.01) |
| *A47B 9/00* | (2006.01) |

(52) U.S. Cl.

CPC ..... *A47B 9/18* (2013.01); *A47B 21/02* (2013.01); *A47B 2009/006* (2013.01)

(58) Field of Classification Search

CPC ..... A47B 9/18; A47B 21/02; A47B 2009/006; A47B 3/00; A47B 3/0002

USPC ..... 108/115

See application file for complete search history.

(56) References Cited

U.S. PATENT DOCUMENTS

| | | | | | |
|---|---|---|---|---|---|
| 1,099,649 | A * | 6/1914 | Hartley | A47B 3/00 | 108/162 |
| 1,561,438 | A * | 11/1925 | Winship | A47B 9/18 | 108/8 |
| 2,110,068 | A * | 3/1938 | Kowalski | A47B 1/056 | 108/79 |
| 2,675,288 | A * | 4/1954 | Usher | A47B 85/02 | 312/194 |
| 3,009,752 | A * | 11/1961 | Margulis | A47B 17/00 | 312/280 |
| 3,652,051 | A * | 3/1972 | McFarlane | A47B 23/001 | 248/444 |

(Continued)

*Primary Examiner* — Daniel J Troy
*Assistant Examiner* — Timothy M Ayres
(74) *Attorney, Agent, or Firm* — NK Patent Law

(57) ABSTRACT

Collapsible table assembly includes a top panel, a first side panel and a second side panel selectively, each engaged with the bottom facing surface of the top panel. A front panel pivotably connects with the top panel, the first side panel, and the second side panel. A latch carried by the front panel engages with a corresponding latch carried on the top panel when the top panel is pivotably rotated towards the front panel in a stowing position. The first side panel and second side panel are pivotable towards the front panel. In operation, the assembly is moved from an assembled position to the stowed position when the first side panel and second side panel are pivoted towards the front panel, and the top panel is pivoted until the corresponding latch on the top panel and front panel are engaged.

8 Claims, 4 Drawing Sheets

(56) References Cited

U.S. PATENT DOCUMENTS

| | | | | | |
|---|---|---|---|---|---|
| 4,065,195 | A * | 12/1977 | Fahmie | A01K 5/0114 | 312/258 |
| 5,315,935 | A * | 5/1994 | Weisenfels | A47B 3/10 | 108/115 |
| 5,882,098 | A * | 3/1999 | Brown | A47B 3/08 | 108/179 |
| 5,997,113 | A * | 12/1999 | Benson | A47B 3/12 | 108/115 |
| 7,096,797 | B2 * | 8/2006 | Sharpe | A47B 3/00 | 108/43 |
| 7,770,527 | B2 * | 8/2010 | Hand | A47B 37/02 | 108/115 |
| 2014/0165884 | A1 * | 6/2014 | O'Gara | A47B 3/002 | 108/115 |

* cited by examiner

COLLAPSIBLE TABLE AND DESK ASSEMBLY FOR CONVERTING A STANDARD DESK INTO A STAND-UP DESK

CROSS-REFERENCE TO RELATED APPLICATIONS

This application claims priority to U.S. Provisional Patent Application No. 62/777,536 filed on Dec. 10, 2018, the entire contents of which is incorporated by reference herein.

TECHNICAL FIELD

This application relates to a collapsible table and desk assembly advantageous for use in accommodating a conventional standing desk arrangement, and more particularly, towards a desk assembly that collapses into a compact arrangement for ease in transport.

BACKGROUND

Most offices, work or study environments come pre-furnished with sitting desk arrangements. If an individual prefers to stand while working it is therefore advantageous to have a portable apparatus that unfolds and can be utilized with the existing furnishings. An apparatus is described that sits on top of existing desk structures permitting an individual to have a standing desk. Its design and hinge structure is in such a manner that an individual can lean on the apparatus and it will remain very stable while also being light and foldable to allow for transport with the individual to a different work station.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

Disclosed herein is a collapsible table assembly 10. Collapsible table assembly 10 includes a top panel 12, a first side panel 14 selectively engaged with a bottom facing surface 16 of the top panel 12, and a second side panel 20 selectively engaged with the bottom facing surface 16 of the top panel 12. A front panel 22 pivotably connects with the top panel 12, the first side panel 14, and the second side panel 20. A latch 24 carried by the front panel 22 is configured for engaging with a corresponding latch 26 carried on the top panel 12 when the top panel 12 is pivotably rotated towards the front panel 22 in a stowing position. The first side panel 14 and second side panel 20 are pivotable towards the front panel 22. In operation, the assembly 10 is moved from an assembled position to the stowed position when the first side panel 14 and second side panel 20 are pivoted towards the front panel 22, the top panel 12 is pivoted until the corresponding latch 26 on the top panel 12 and front panel 22 are engaged, thereby securing the first side panel 14 and the second side panel 20 between the top panel 12 and the front panel 22.

According to one or more embodiments, the first side panel 14 and the second side panel 20 each define a cutout 28, the cutout 28 providing clearance for the latch 24 carried on the front panel 22.

According to one or more embodiments, the first side panel 14 is pivotably attached to the front panel 22 at a position spaced-apart from the front panel 22, wherein the second side panel 20 is pivotably attached to the front panel 22 at a closer-spaced position than the first side panel 14 such that the second side panel 20 is received against the front panel 22 when pivoted towards the front panel 22 and the first side panel 14 is received against the second side panel 20 when pivoted towards the front panel 22 before the top panel 12 is pivoted towards the front panel 22 until the latch 24 on the front panel 22 and the corresponding latch 26 on the top panel 12 are engaged.

According to one or more embodiments, each of the first side panel 14 and the second side panel 20 define a recess 30 at a portion about where the first side panel 14 engages the top panel 12 when in an assembled position and where the second side panel 20 engages the top panel 12 when in an assembled position, the recess 30 providing a surface for gripping of the assembled table assembly 10.

According to one or more embodiments, the top panel 12 defines respective recesses 32 that are continuous with the recesses of the first side panel and the second side panel when in the assembled position.

According to one or more embodiments, the top panel 12 defines a first portion 34 and a second portion 36, the second portion 36 being pivotably attached to the first portion 34 and providing pivoting functionality towards the front panel 22.

According to one or more embodiments, the first portion 34 provides a dimension that is large enough to accommodate the first side panel 14, second side panel 20, and top panel 12 when the assembly 10 is in the retracted position.

According to one or more embodiments, the second portion 36 defines a protrusion 40 along a dimension thereof for preventing pivoting movement of either of the first side panel 14 or the second side panel 20 beyond a predetermined location when in the assembled position.

According to one or more embodiments, each of the first side panel 14 and the second side panel 20 defines a latch assembly 42 for latchably engaging the top panel 12 when in the assembled position.

According to one or more embodiments, the assembly 10 is placeable on a flat surface of a conventional desk to convert the conventional desk to a stand-up desk, with the assembly 10 moveable to the assembled position to form the stand-up desk.

DETAILED DESCRIPTION

The following description and figures are illustrative and are not to be construed as limiting. Numerous specific details are described to provide a thorough understanding of the disclosure. In certain instances, however, well-known or conventional details are not described in order to avoid obscuring the description. References to "one embodiment" or "an embodiment" in the present disclosure may be (but are not necessarily) references to the same embodiment, and such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. It will be appreciated that same thing can be said in more than one way.

Alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to various embodiments given in this specification.

Without intent to limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

Figure 1:
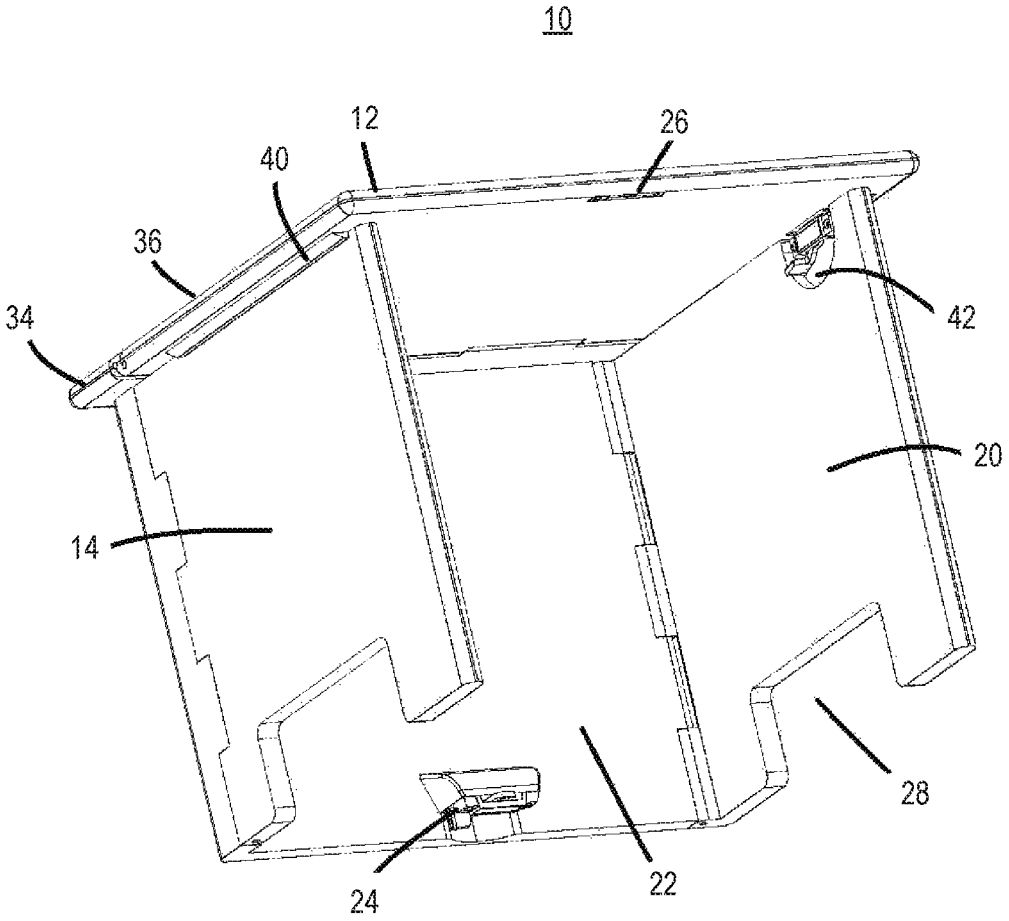
FIG. 1 is a perspective view of a collapsible table assembly 10 according to one or more embodiments disclosed herein.
Figure 2:
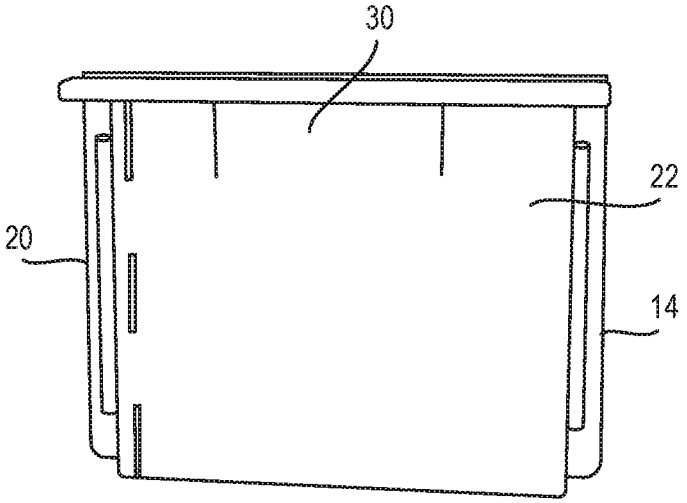
FIG. 2 is a front view of the collapsible table assembly 10 according to one or more embodiments disclosed herein.
Figure 3:
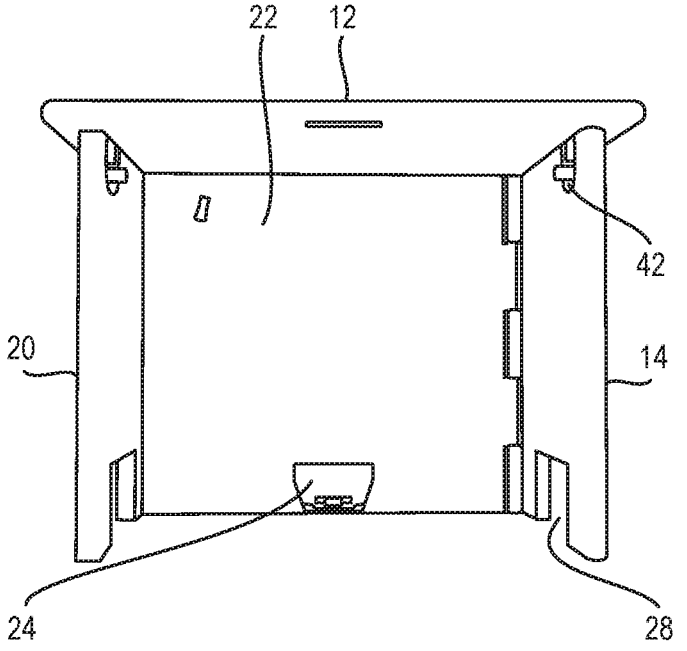
FIG. 3 is a rear view of the collapsible table assembly 10 according to one or more embodiments disclosed herein.
Figure 4:
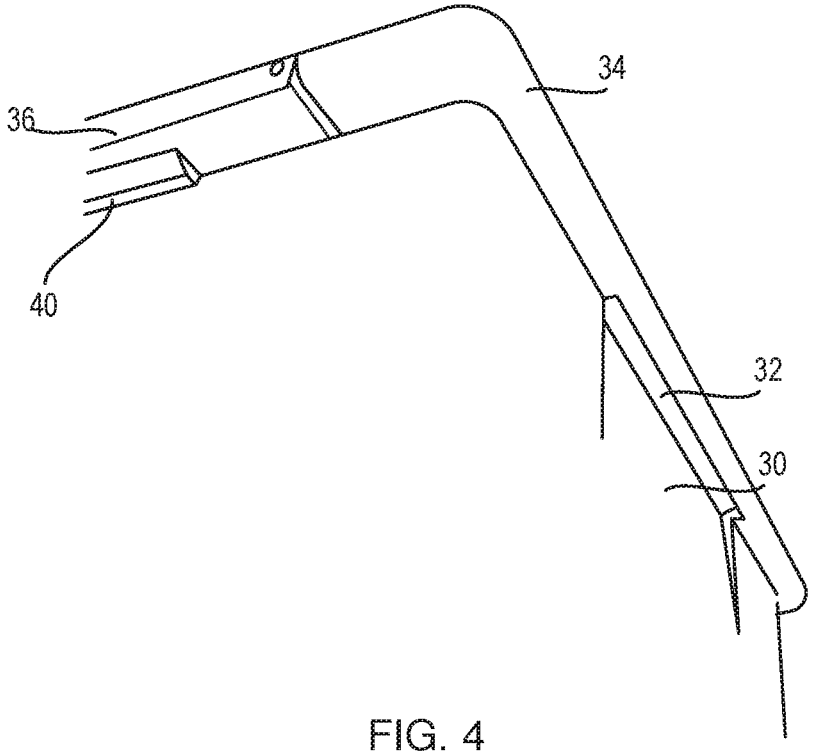
FIG. 4 is an upward facing, perspective view of the collapsible table assembly 10 according to one or more embodiments disclosed herein.
Figure 5:
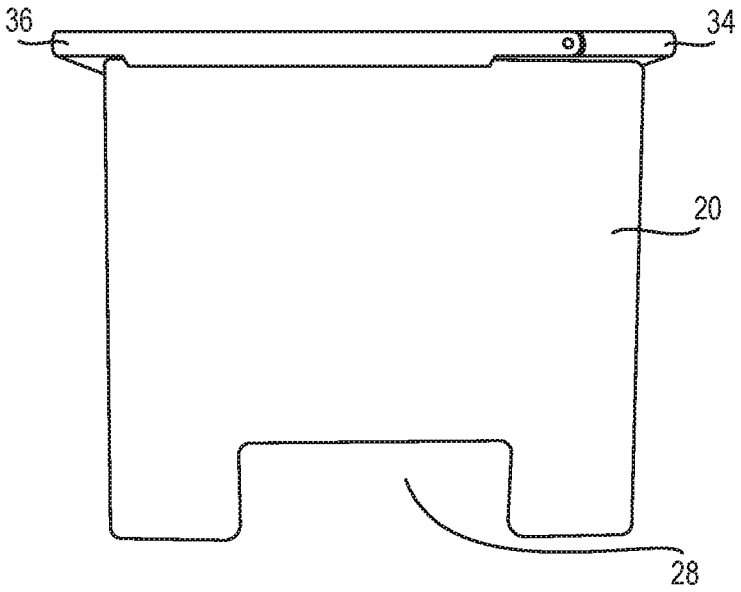
FIG. 5 is a right-side view of the collapsible table assembly 10 according to one or more embodiments disclosed herein.

As will be described in greater detail below with reference to the figures, the subject matter described herein provides for a collapsible table assembly. With reference primarily to FIG. 1 but with additional reference to the remaining figures, a collapsible table assembly 10 includes a top panel 12, a first side panel 14 selectively engaged with a bottom facing surface 16 of the top panel 12, and a second side panel 20 selectively engaged with the bottom facing surface 16 of the top panel 12. In FIG. 1, the assembly 10 is shown in the assembled position. In this position, the assembly 10 may be placed on top of a standard desk to create a "stand up" desk.

A front panel 22 is pivotably connected with the top panel 12, the first side panel 14, and the second side panel 20. The pivotal connection allows for collapsing of the assembly 10 into a stowed position as will be described later and is well illustrated in FIG. 6 and FIG. 7. A latch 24 is carried by the front panel 22 and configured for engaging with a corresponding latch 26 carried on the top panel 12 when the top panel 12 is pivotably rotated towards the front panel 22 in a stowing position. Latch 26 is shown to include a recess, but any appropriate latching configuration can be used.

In operation, the first side panel 14 and second side panel 20 are pivotable towards the front panel 22. In operation, the assembly 10 is moved from an assembled position (as shown, for example, in FIG. 1) to the stowed position (as shown, for example, in FIG. 6 and FIG. 7) when the first side panel 14 and second side panel 20 are pivoted towards the front panel 22, the top panel 12 is pivoted until the latch 24 on the front panel 22 and the corresponding latch 26 on the top panel 12 are engaged, thereby securing the first side panel 14 and the second side panel 20 between the top panel 12 and the front panel 22.

Figure 6:
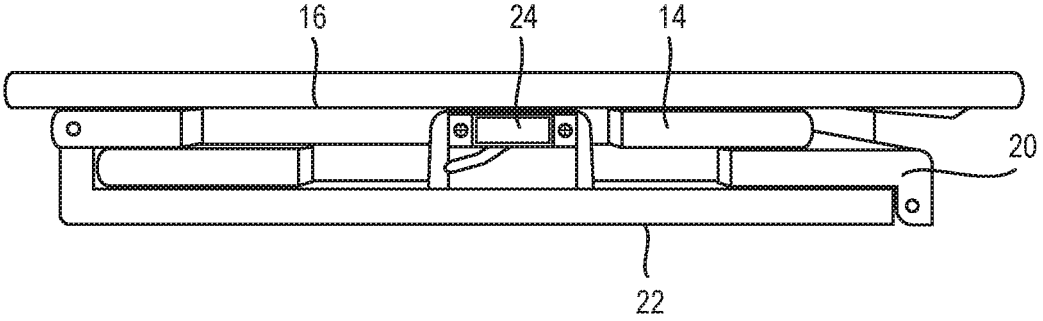
FIG. 6 is a view of the collapsible table assembly 10 shown in the stowed position according to one or more embodiments disclosed herein.
Figure 7:
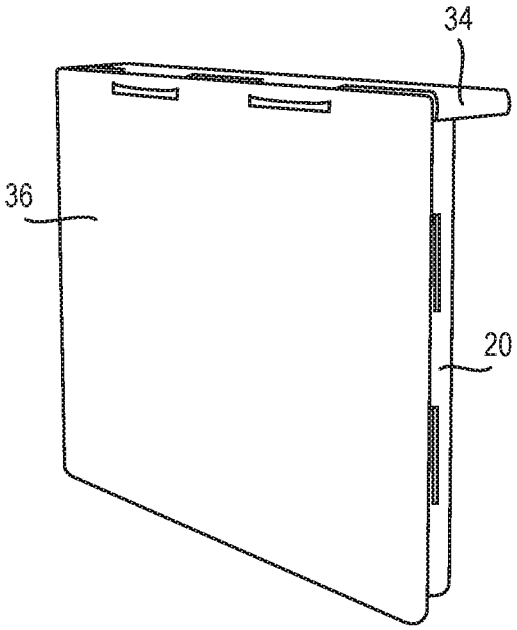
FIG. 7 is a perspective view of the collapsible table assembly 10 shown in the stowed position according to one or more embodiments disclosed herein.

In this manner, in the stowed position, the assembly 10 collapses into a compact, easy to carry and transport assembly (see FIG. 6 and FIG. 7). The collapsibility is allowed through certain advantageously provided features as described herein. Not only does the assembly 10 collapse into the stowed position, but through the use of latches 24, 26, the assembly 10 is locked into place when collapsed. The assembly 10 includes features that allow for ease of portability of the assembly 10. Specifically, the first side panel 14 and the second side panel 20 each define a cutout 28. The cutout 28 provides clearance for the latch 24 carried on the front panel 22 when the front panel 22 and either of the first side panel 14 and second side panel 20 are pivoted towards the front panel 22. More specifically, the first side panel 14 is pivotably attached to the front panel 22 at a position spaced-apart from the front panel 22, and the second side panel 20 is pivotably attached to the front panel 22 at a closer-spaced position than the first side panel 14 such that the second side panel 20 is received against the front panel 22 when pivoted towards the front panel 22 and the first side panel 14 is received against the second side panel 20 when pivoted towards the front panel 22; after this, the top panel 12 is pivoted towards the front panel 22 until the latch 24 on the front panel 22 and the corresponding latch 26 on the top panel 12 are engaged. This is illustrated well in FIG. 6 and FIG. 7.

In one or more embodiments, each of the first side panel 14 and the second side panel 20 define a recess 30 at a portion about where the first side panel 14 engages the top panel 12 when in an assembled position and where the second side panel 20 engages the top panel 12 when in an assembled position. The recess 30 provides a surface for gripping of the assembled table assembly 10. In one or more embodiments, the top panel 12 defines respective recesses 32 that are continuous with the recesses 30 of the first side panel 14 and the second side panel 20 when in the assembled position.

A further advantageous aspect disclosed herein is that the top panel 12 defines a first portion 34 and a second portion 36, the second portion 36 being pivotably attached to the first portion 34 and providing pivoting functionality towards the front panel 22. In one or more embodiments, the first portion 34 provides a dimension that is large enough to accommodate the first side panel 14, the second side panel 20, and the top panel 12 when the assembly 10 is in the retracted position. The second portion 36 defines a protrusion 40 along a dimension thereof for preventing pivoting movement of either of the first side panel 14 or the second side panel 20 beyond a predetermined location when in the assembled position.

As illustrated in FIG. 1, each of the first side panel 14 and the second side panel 20 defines a latch assembly 42 for latchably engaging the top panel 12 when in the assembled position; for this purpose, a corresponding recess or latching assembly may be carried on the top panel 12. The latch assembly 42 may be disengaged by operation of a hand-controlled lever, button, or the like.

In operation, the assembly 10 is carried in the stowed position by a user. When the user desires to convert a conventional desk into a stand-up desk, the user unpacks the assembly 10 from the stowed position into the ready for use position. In that instance, the in use assembly 10 is placed onto a desk surface to effectively elevate the working surface for the user. Accordingly, the assembly 10 is placeable on a flat surface of a conventional desk to convert the conventional desk to a stand-up desk, with the assembly 10 moved to the assembled position to form the stand-up desk.

In various embodiments, the assembly 10 can be constructed of materials that provide adequate strength for supporting items typically expected to be placed on a stand-up desk. Further, the design and hinge structure of the assembly 10 is provided in such a manner that an individual can lean on the assembly 10 and the assembly 10 will remain very stable while also being light and foldable to allow for transport with the individual to a different work station. One or more components of the assembly 10 may be constructed using injection molding methods.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A collapsible table assembly comprising:

a top panel;

a first side panel selectively engaged with a bottom facing surface of the top panel;

a second side panel selectively engaged with the bottom facing surface 16 of the top panel;

a front panel pivotably connected with the top panel, the first side panel, and the second side panel;

a latch carried by the front panel and configured for engaging with a corresponding latch carried on the top panel when the top panel is pivotably rotated towards the front panel in a stowing position, wherein the first side panel and second side panel are pivotable towards the front panel, wherein, in operation, the assembly is moved from an assembled position to the stowed position when the first side panel and second side panel are pivoted towards the front panel, the top panel is pivoted until the corresponding latch on the top panel and front panel are engaged, thereby securing the first side panel and the second side panel between the top panel and the front panel, wherein each of the first side panel and the second side panel defines a cutout at a bottom edge thereof, the bottom edge positioned opposite to a top edge that selectively engages with the bottom facing surface of the top panel, the cutout providing clearance for the latch carried on the front panel, wherein the front panel defines a recess at a portion about where the front panel engages the top panel when in the assembled position, the recess providing a surface for gripping of the assembled table assembly, wherein the top panel defines a respective recess that is continuous with the recess of the front panel when in the assembled position.

2. The assembly of claim 1, wherein the first side panel is pivotably attached to the front panel at a position spaced-apart from the front panel, wherein the second side panel is pivotably attached to the front panel at a closer-spaced position than the first side panel such that the second side panel is received against the front panel when pivoted towards the front panel and the first side panel is received against the second side panel when pivoted towards the front panel before the top panel is pivoted towards the front panel until the latch on the top panel and the corresponding latch on the front panel are engaged.

3. The assembly of claim 1, wherein the top panel defines a first portion and a second portion, the second portion being pivotably attached to the first portion and providing pivoting functionality towards the front panel.

4. The assembly of claim 3, wherein the first portion provides a dimension that is large enough to accommodate the first side panel, second side panel, and top panel when the assembly is in the stowed position.

5. The assembly of claim 3, wherein the second portion defines a protrusion along a dimension thereof for preventing pivoting movement of either of the first side panel or the second side panel beyond a predetermined location when in the assembled position.

6. The assembly of claim 1, wherein each of the first side panel and the second side panel defines a latch assembly for latchably engaging the top panel when in the assembled position.

7. The assembly of claim 1, wherein the assembly is placeable on a flat surface of a conventional desk to convert the conventional desk to a stand-up desk.

8. The assembly of claim 7, wherein the assembly is moved to the assembled position to form the stand-up desk.

* * * * *